US006296029B1

(12) United States Patent
Grivna

(10) Patent No.: US 6,296,029 B1
(45) Date of Patent: Oct. 2, 2001

(54) CENTERING SECTIONAL SHOE ASSEMBLY

(75) Inventor: Howard Grivna, Maple Grove, MN (US)

(73) Assignee: Timesavers, Inc., Minneapolis, MN (US)

( * ) Notice: Subject to any disclaimer, the term of this patent is extended or adjusted under 35 U.S.C. 154(b) by 0 days.

(21) Appl. No.: 09/358,197

(22) Filed: Jul. 21, 1999

(51) Int. Cl.[7] ..... B27C 1/00; B27L 11/00

(52) U.S. Cl. ..... 144/373; 144/117.1; 144/115; 144/242.1; 144/246.1; 144/248.4; 144/250.26; 144/116; 144/375; 198/782; 198/836.2; 451/190; 451/301

(58) Field of Search ..... 144/2.1, 3.1, 4.9, 144/114.1, 116, 117.1, 242.1, 245.2, 246.1, 246.2, 248.4, 248.5, 250.12, 250.13, 250.16, 250.18, 250.26, 375, 115, 248.6, 373; 198/782, 836.2; 451/190, 300, 301, 302, 336

(56) References Cited

U.S. PATENT DOCUMENTS

| | | | | |
|---|---|---|---|---|
| 4,322,919 | | 4/1982 | Gerber . | |
| 4,457,350 | * | 7/1984 | Finnila | 144/117.1 |
| 4,640,056 | | 2/1987 | Stump . | |
| 4,724,877 | | 2/1988 | Culley, Jr. . | |
| 5,368,077 | * | 11/1994 | Croghan et al. | 144/114.1 |

OTHER PUBLICATIONS

Oliver Machine Co., Engineering Drawings, 2040E10012, 2040E10012, 2040E10028, Apr./May 1986.

* cited by examiner

*Primary Examiner*—W. Donald Bray
(74) *Attorney, Agent, or Firm*—Patula & Associates, P.C.

(57) ABSTRACT

A method and apparatus for improved centering of a workpiece in a planer machine includes centering sectional shoe assembly positioned in close proximity to opposed cutting heads, between the cutting heads and a centering feed assembly. The shoe assembly includes a plurality of individually movable pressure shoe sets, comprising an upper shoe and a lower shoe. Each shoe set is operatively connected to a closed circuit, double rod end hydraulic cylinder assembly which selectively and independently positions the shoe set responsive to the surface to the workpiece. A pressure device is also operatively connected to each shoe set to provide a centering force. In use, as the upper or lower shoe of a shoe set is forced away from the centerline of the workpiece, the opposing shoe would automatically move the same amount. The shoe assembly thus centers each and every workpiece independent of the amount of stock removal required. The feed assembly also includes a closed circuit, double rod end hydraulic cylinder assembly to improve centering of the workpiece by the feed assembly.

19 Claims, 2 Drawing Sheets

CENTERING SECTIONAL SHOE ASSEMBLY

The present invention relates to a method and apparatus for positioning workpieces in surfacing machinery, and in particular, a centering assembly for centering workpieces in a planer machine, specifically a centering sectional shoe assembly that adjusts for individual workpiece thicknesses and widths allowing multiple workpieces to be centered and planed at the same time by a planer machine having opposed cutting heads.

BACKGROUND OF THE INVENTION

Surfacing machinery is used to perform surface operations on workpieces, for example, to sand or plane lumber, planks, panels, etc. Such surfacing machinery typically includes upper and lower heads for cutting or sanding the workpieces, and a feed assembly for advancing the workpiece through the heads. The feed assembly preferably provides a self-centering effect so that whatever amount of material is being removed, one-half will be removed from each side, thereby maximizing yield.

Self-centering feed assemblies for abrasive grinding machines are disclosed in U.S. Pat. No. 4,322,919 issued to Gerber on Apr. 6, 1982 and in U.S. Pat. No. 4,640,056 issued to Stump on Feb. 3, 1987, both of which are herein incorporated by reference. These prior art feed assemblies allowed each workpiece to float or center at the sanding head position and to thereby achieve equal stock removal on each side of each board. Because the abrasive belt heads themselves had a self-centering effect, these feed assemblies were required to provide the necessary horizontal forces required to feed each board, but follow the surface of each board so as to not interfere with the centering effect at the abrasive belt heads.

However, when used in connection with cutting heads, as opposed to sanding or grinding heads, these prior art feed assemblies were not adequate to achieve the desired individual centering result, since the cutting heads do not provide a self-centering effect. This is due to the fact that when using cutting heads instead of abrasive heads, the vertical forces on the workpiece are exactly the opposite, as a cutting head tries to pull the board into the cutter, whereas an abrasive head tries to push the board away from the abrasive belt. As a result, the cutting heads would remove an unequal amount from each side and tend to gouge or otherwise cut the workpiece unevenly, especially if the workpiece is uneven, warped or contains other variations. In an attempt to compensate for such problems, the cutting heads normally are displaced relative to each other, as opposed to the desired position of directly opposing each other, resulting in uneven stock removal from each side.

Accordingly, there is a need in a cutting head planer machine for a method and apparatus to adequately center and feed workpieces to the cutting head assembly so that an equal amount of material will be removed from both sides of each and every board independent of individual board thickness variations. The present invention fulfills such a need.

BRIEF SUMMARY OF THE INVENTION

The present invention comprises a centering sectional shoe assembly for use in surfacing machinery, and in particular a planer machine having cutting heads. The shoe assembly is positioned in close proximity to the cutting heads (which directly oppose each other), and between the cutting heads and a centering feed assembly. The shoe assembly includes a plurality of individually movable pressure shoe sets, each set comprising an upper shoe and a lower shoe. Each shoe set is operatively connected to a closed circuit, double rod end hydraulic cylinder assembly which selectively and independently positions the shoe set responsive to the surface to the workpiece. A means for exerting a force is also operatively connected to each shoe set to provide a centering force. In use, as the upper or lower shoe of a shoe set is forced away from the centerline of the workpiece, the opposing shoe would automatically move the same amount. The shoe assembly thus centers each and every workpiece independent of the amount of stock removal required. Further, it is desirable that the feed assembly of the present invention likewise includes a closed circuit, double rod end hydraulic cylinder assembly to improve centering of the workpiece by the feed assembly.

Accordingly, it is the principle object of the present invention to provide a method and apparatus for positioning workpieces in surfacing machinery.

It is a further object of the invention to provide a centering assembly for centering workpieces in a planer machine.

It is also an object of the invention to provide a centering sectional shoe assembly that adjusts for individual workpiece thicknesses and widths allowing multiple workpieces to be centered and planed at the same time by a planer machine having opposed cutting heads.

It is an additional object of the present invention to provide a closed circuit, double rod end hydraulic cylinder assembly for a centering sectional shoe assembly.

It is another object of the present invention to provide an improved centering feed assembly having a closed circuit, double rod end hydraulic cylinder assembly.

Numerous other advantages and features of the invention will become readily apparent from the detailed description of the preferred embodiment of the invention, from the claims, and from the accompanying drawings in which like numerals are employed to designate like parts throughout the same.

BRIEF DESCRIPTION OF THE DRAWINGS

A fuller understanding of the foregoing may be had by reference to t accompanying drawings wherein.

DETAILED DESCRIPTION OF THE PREFERRED EMBODIMENT OF THE PRESENT INVENTION

Figure 1:
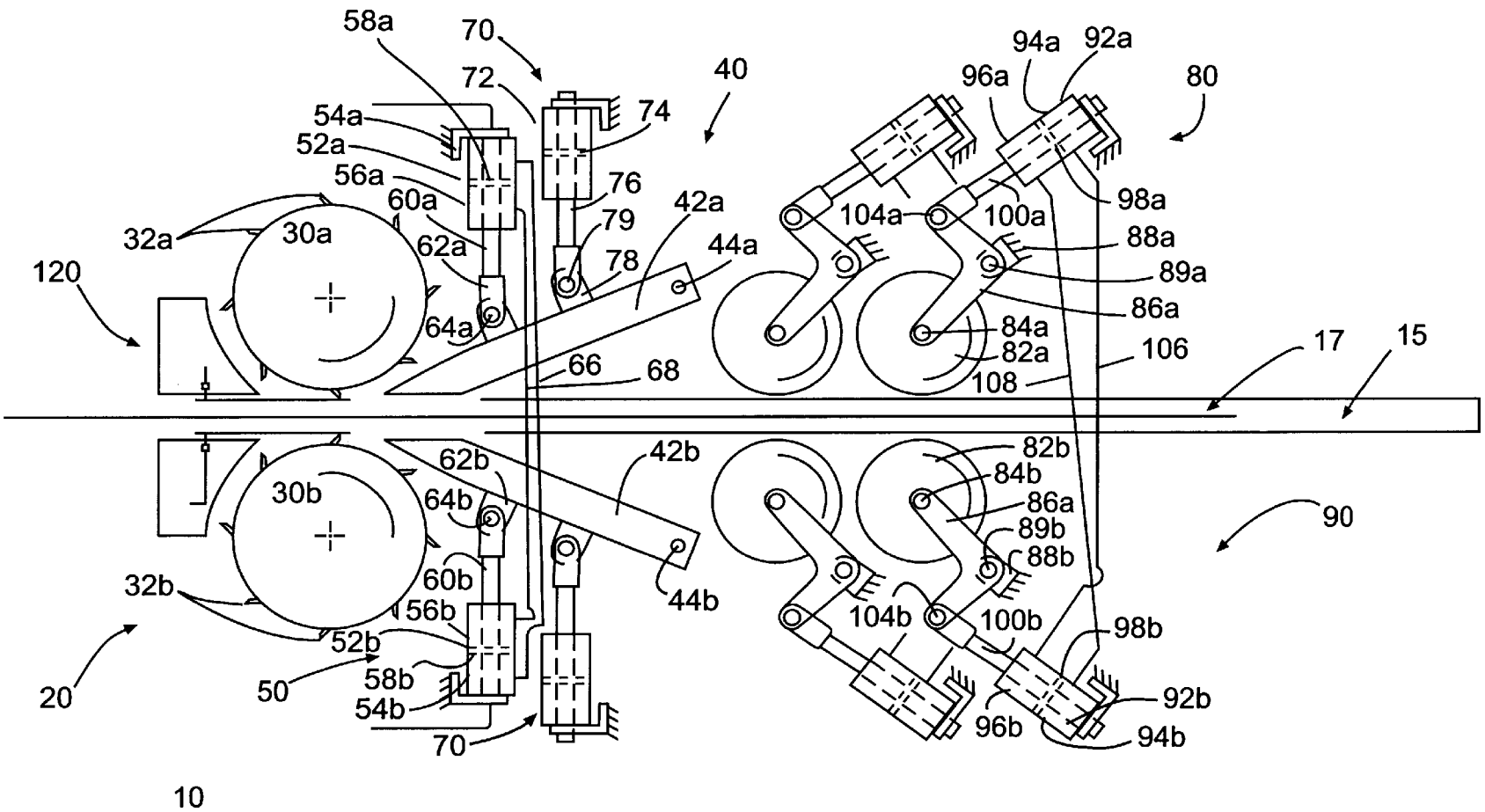
FIG. 1 is a side view of the present invention.

While the invention is susceptible of embodiment in many different forms, there is shown in the drawings and will be described herein in detail a preferred embodiment of the invention. It should be understood however that the present disclosure is to be considered an exemplification of the principles of the invention and is not intended to limit the spirit and scope of the invention and/or claims of the embodiment illustrated.

FIG. 1 illustrates a side view of the present invention 10 in use in a cutting head planer machine having a cutting head assembly 20 defined by directly opposed upper cutting head 30*a* and lower cutting head 30*b*. The cutting heads each include cutting teeth 32*a* and 32*b* respectively, are suitably mounted and driven as is commonly known in the art. The cutting heads are mounted at any desired distance from each other, to define the thickness or height of the finished workpiece. For example, if the cutting heads are set one inch apart, then a workpiece with a thickness greater than one inch will have a thickness of one inch after passing through the workpiece.

A centering shoe assembly 40 is shown positioned in close proximity to the cutting heads. Assembly 40 comprises a series of shoe sets, positioned across the width of the machine, each set made up of upper shoe 42*a* and lower shoe 42*b*. The shoes 42*a* and 42*b* are mounted for pivotable movement about pivots 44*a* and 44*b* respectively. Movement of each set of shoes is effected as described below by closed circuit, double rod end hydraulic cylinder assemblies 50 operatively connected to each shoe set.

The shoes assemblies are mounted such that the minimum distance between the upper and lower shoes is less than the distance between the cutting heads. For example, if the distance between the cutting heads is one inch, then the minimum distance between the upper and lower shoes would be less than one inch, such as ⅞ inches. In such an example, a workpiece having an initial thickness of less than one inch will pass through the machine unaffected, i.e, without contacting the cutting heads. In the prior art, a workpiece originally thinner than desired would still contact the surfacing heads and be made even thinner.

Assembly 50 comprises an upper double rod end hydraulic cylinder 52*a* and a lower double rod end hydraulic cylinder 52*b*. Each cylinder 52*a* and 52*b* contains a fluid (such as oil or any suitable liquid or gas) filled first chamber 54*a* and 54*b* and second chamber 56*a* and 56*b* respectively, separated by a piston 58*a* and 58*b* respectively. Pistons 58*a* and 58*b* move piston rods 60*a* and 60*b* respectively, which are pivotably attached to a shoe mount 62*a* and 62*b* respectively, by pivot 64*a* and 64*b* respectively, to control movement of shoes 42*a* and 42*b*.

Cylinders 52*a* and 52*b* are operatively connected by a first conduit 66 and a second conduit 68. First conduit 66 provides fluid communication between first chamber 54*a* and second chamber 56*b*, while second conduit 68 provides fluid communication between second chamber 56*a* and first chamber 54*b*. In this manner, as one of the pistons 58*a* and 58*b* move, the other piston moves the same amount in the same direction relative to the center line (i.e, both move either away from the centerline or towards the centerline), since the volume of the fluid in the first chambers 54*a* and 54*b* and the volume in the second chambers 56*a* and 56*b* remain equal. Thus, if shoe 42*a* is forced away from centerline 17 by workpiece 15, piston 58*a* moves, forcing fluid out of first chamber 54*a*, through conduit 66, and into second chamber 56*b*. This in turn moves piston 52*b*, forcing fluid out of first chamber 54*b*, through conduit 68 and into second chamber 56*a*, thus moving shoe 42*b* away from the center line the same distance as shoe 42*a*.

To provide a centering force, a means 70 for exerting pressure on the shoes is operatively connected to at least one of the shoes 42*a* and 42*b*. Means 70 preferably takes the form of an air cylinder 72 having piston 74 which moves piston rod 76 pivotably attached to the shoe at shoe mount 78 by pivot 79. Air cylinder 72 selectively provides adjustable pressure to the shoes to help produce the desired centering effect.

Also illustrated in FIG. 1 is a centering feed assembly 80 having a plurality of staggered drive wheel sets, of the general type as described in U.S. Pat. No. 4,322,919. It should be understood that a feed mechanism of the general type as described in U.S. Pat. No. 4,640,056 could also be used.

The feed assembly 80 however differs from these prior art feed assemblies in that they are operatively controlled by another closed circuit double rod end hydraulic cylinder assembly 90. Accordingly, opposing drive wheels 82*a* and 82*b* are mounted on drive shafts 84*a* and 84*b* respectively, and are driven by any suitable means as is known in the art. Drive wheels 82*a* and 82*b* are mounted at the and of an L-shaped link 86*a* and 86*b* respectively, which pivot at link mounts 88*a* and 88*b* respectively about link pivots 89*a* and 89*b* respectively.

Assembly 90 comprises an upper double rod end hydraulic cylinder 92*a* and a lower double rod end hydraulic cylinder 92*b*. Each cylinder 92*a* and 92*b* contains a fluid filled first chamber 94*a* and 94*b* and second chamber 96*a* and 96*b* respectively, separated by a piston 98*a* and 98*b* respectively. Pistons 98*a* and 98*b* move piston rods 100*a* and 100*b* respectively, which are pivotably attached to the other end of link 86*a* and 86*b* respectively, by pivot 104*a* and 104*b* respectively, to control movement of drive wheels 82*a* and 82*b*.

Cylinders 92*a* and 92*b* are operatively connected by a first conduit 106 and a second conduit 108. First conduit 106 provides fluid communication between first chamber 94*a* and second chamber 96*b*, while second conduit 108 provides fluid communication between second chamber 96*a* and first chamber 94*b*. Thus when one drive wheel moves away from the centerline 17, the opposite wheel move away from the centerline an equal distance. This provides an improved centering effect of the workpiece 15 as it is moved through the cutting heads 30*a* and 30*b*, and into exit shoe assembly 120, which supports, stabilizes, guides and provides a flattening effect to the finished workpiece as it exits the cutting head assembly 20.

Figure 2:
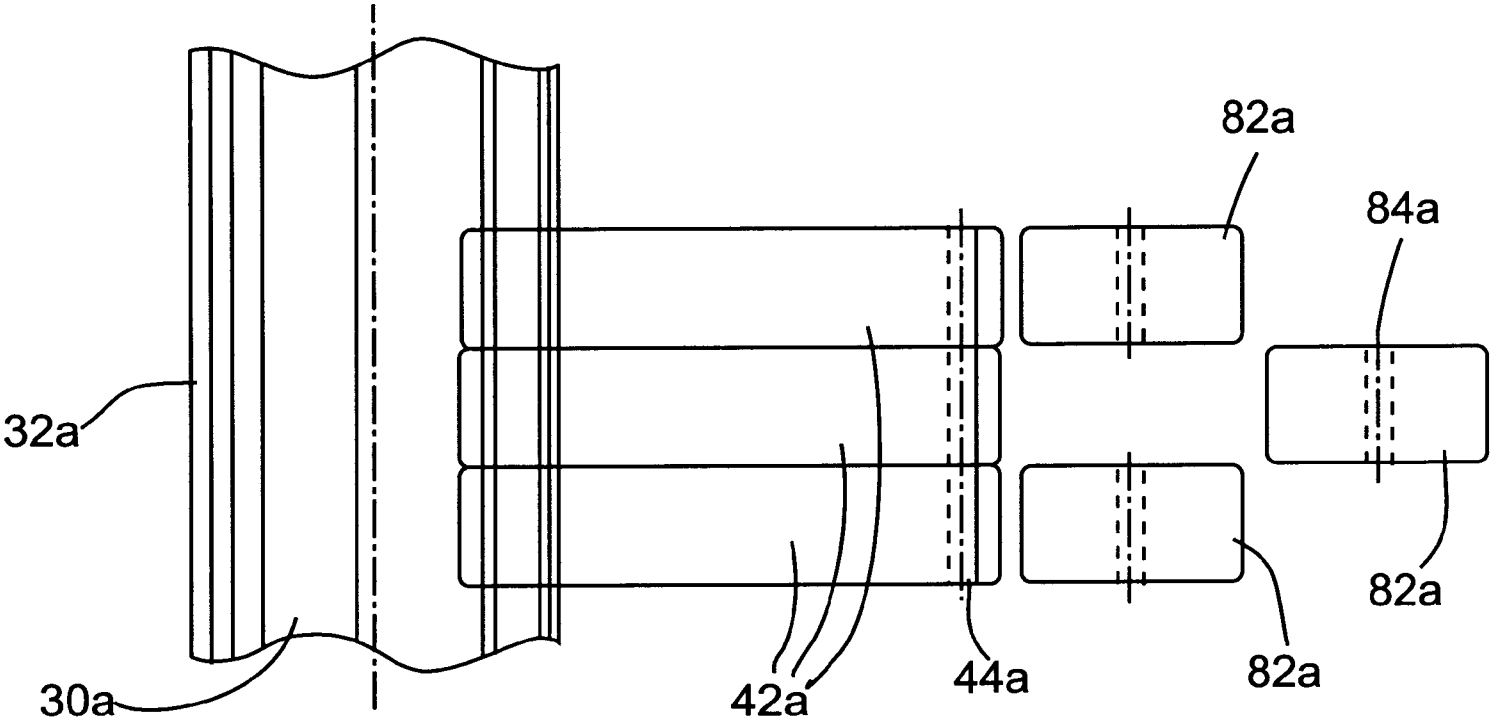
FIG. 2 is a top view of the present invention in the absence of the hydraulic cylinder assemblies.

FIG. 2 is a top view of the present invention, in the absence of assemblies 50 and 90, and means 70, illustrating the relative location of the staggered drive wheels 82*a*, the sectional shoes 42*a*, and the cutting head 30*a*. As can be seen, the sectional shoes are located between the cutting head and the drive wheels, in close proximity to the cutting head. It should be understood that the drive wheels need not be staggered, but could be aligned.

It should be understood that the embodiments herein described are merely illustrative of the principles of the present invention. Various modifications may be made by those skilled in the art without departing from the spirit or scope of the claims which follow.

What is claimed is:

1. An apparatus for centering a workpiece along a centerline in a planer machine having top and bottom cutting heads, said apparatus comprising:

at least one set of biasing means pivotably mounted in said machine;

means for operatively connecting said at least one set of biasing means for direct, synchronized movement relative to said centerline; and a means for applying pressure to said at least one set of biasing means.

2. The apparatus of claim 1, wherein said at least one set of biasing means are mounted in close proximity to both of said top and bottom cutting heads.

3. The apparatus of claim 1, wherein said at least one set of biasing means includes a shoe assembly.

4. The apparatus of claim 3, wherein said shoe assembly includes an upper shoe and a lower shoe.

5. The apparatus of claim 1, wherein said means for operatively connecting consists of a hydraulic cylinder assembly.

6. The apparatus of claim 5, wherein said hydraulic cylinder assembly is a closed circuit, double rod end hydraulic cylinder assembly which directly connects said at least one set of biasing means.

7. The apparatus of claim 1, wherein said at least one set of biasing means includes a shoe assembly having an upper shoe and a lower shoe; and wherein said means for operatively connecting is a closed circuit, double rod end hydraulic cylinder assembly having un upper hydraulic cylinder and a lower hydraulic cylinder directly connected via a first conduit and a second conduit, said upper hydraulic cylinder being directly connected to said upper shoe and said lower hydraulic cylinder being directly connected to said lower shoe; said cylinder assembly providing synchronized movement of said upper and lower shoes relative to said centerline such that when one of said upper and lower shoes moves towards the centerline, then the other shoe moves towards the centerline the same distance, and when one of said upper and lower shoes moves away from the centerline, then the other shoe moves away from the centerline the same distance.

8. A sectional shoe assembly for centering workpieces, comprising:

at least one shoe set comprising a pivotable upper shoe and a pivotable lower shoe defining a distance therebetween;

a means for directly synchronizing movement of said upper and lower shoes; and a means for applying pressure to said at least one shoe set.

9. The shoe assembly of claim 8, wherein said means for synchronizing movement comprises a closed circuit, double rod end hydraulic cylinder assembly directly connecting said upper shoe to said lower shoe.

10. The shoe assembly of claim 9, wherein said closed circuit, double rod end hydraulic cylinder assembly comprises an upper hydraulic cylinder operatively and directly connected to said upper shoe, and a lower hydraulic cylinder operatively and directly connected to said lower shoe, said upper and lower hydraulic cylinders each having a first chamber and a second chamber, said first chamber of said upper hydraulic cylinder being in fluid communication with said second chamber of said lower hydraulic cylinder, and said second chamber of said upper hydraulic cylinder being in fluid communication with said first chamber of said lower hydraulic cylinder.

11. A planer machine comprising:

a cutter head assembly, having a top cutter head and a bottom cutter head;

a feed assembly; and a centering sectional shoe assembly positioned between said cutter head assembly and said feed assembly, said shoe assembly includes at least one shoe set comprising an upper shoe and a lower shoe, said upper show being in close proximity to said top cutter head and said lower shoe being in close proximity to said bottom cutter head.

12. The machine of claim 11, wherein said cutter head assembly includes opposed cutter heads, wherein said top cutter head is directly opposed from said bottom cutter head.

13. The machine of claim 12, wherein said upper and lower shoes move together via a closed circuit, double rod end hydraulic cylinder assembly, such that when one of said upper and lower shoes is moved relative to a centerline, the other of said upper and lower shoes is directly moved an equal distance relative to said centerline.

14. The machine of claim 13, wherein said closed circuit, double rod end hydraulic cylinder assembly comprises an upper hydraulic cylinder operatively connected directly to said upper shoe, and a lower hydraulic cylinder operatively connected directly to said lower shoe, said upper and lower hydraulic cylinders being in fluid communication with each other.

15. A method for centering workpieces in a planer machine having top and bottom cutting heads and a feeding assembly, comprising the steps of:

aligning said top and bottom cutting heads;

mounting at least one set of upper and lower centering shoes in close proximity to said top and bottom cutting heads; and operatively and directly connecting said upper and lower shoes for synchronized movement via a closed circuit, double rod end hydraulic cylinder assembly.

16. The machine of claim 11, wherein said feed assembly includes at least one set of an upper feed mechanism and a lower feed mechanism, wherein said upper and lower feed mechanisms move together via a closed circuit, double rod end hydraulic cylinder assembly, such that when one of said upper and lower feed mechanisms is moved relative to a centerline, the other of said upper and lower feed mechanisms is directly moved an equal distance relative to said centerline.

17. The machine of claim 16, wherein said closed circuit, double rod end hydraulic cylinder assembly comprises an upper hydraulic cylinder operatively connected directly to said upper feed mechanism, and a lower hydraulic cylinder operatively connected directly to said lower feed mechanism, said upper and lower hydraulic cylinders being in fluid communication with each other.

18. The shoe assembly of claim 9, wherein said closed circuit, double rod end hydraulic cylinder assembly directly connects said upper shoe to said lower shoe in the absence of mechanical links.

19. A planar machine comprising:

a top cutter head;

a bottom cutter head directly opposed from said top cutter head;

a top feed mechanism;

a bottom feed mechanism;

a first hydraulic cylinder assembly directly connecting said top feed mechanism to said bottom feed mechanism;

a top centering shoe assembly;

a bottom centering shoe assembly; and a second hydraulic cylinder assembly directly connecting said top centering shoe assembly to said bottom centering shoe assembly.

* * * * *

UNITED STATES PATENT AND TRADEMARK OFFICE

CERTIFICATE OF CORRECTION

PATENT NO. : 6,296,029 B1
DATED : October 2, 2001
INVENTOR(S) : Grivna

It is certified that error appears in the above-identified patent and that said Letters Patent is hereby corrected as shown below:

Column 2,
Line 17, "principle" should be -- principal --.
Line 43, "t" should be -- the --.

Column 3,
Line 14, "shoes" should be -- shoe --.

Column 4,
Line 7, the 2nd occurrence of "and" should be -- end --.

Column 5,
Line 54, "show" should be -- shoe --.

Signed and Sealed this

Nineteenth Day of March, 2002

*Attest:*

*Attesting Officer*

JAMES E. ROGAN
*Director of the United States Patent and Trademark Office*